United States Patent [19]

Becker

[11] Patent Number: 4,834,160

[45] Date of Patent: May 30, 1989

[54] AWNING DEPLOYMENT AND TENSIONING SYSTEM

[76] Inventor: Alvin L. Becker, 8615 Regner Ct., San Diego, Calif. 92119

[21] Appl. No.: 72,414

[22] Filed: Jul. 13, 1987

[51] Int. Cl.[4] ..... E04F 10/06

[52] U.S. Cl. ..... 160/66; 160/264; 160/265

[58] Field of Search ..... 160/66, 61, 64, 76, 160/75, 264, 265, 274, 310, 311

[56] References Cited

U.S. PATENT DOCUMENTS 755,675 3/1904 Kirby, Jr. ..... 160/264 X
3,279,528 10/1966 Gambon et al. ..... 160/274

FOREIGN PATENT DOCUMENTS 3524343 7/1986 Fed. Rep. of Germany ..... 160/66
2556403 6/1985 France ..... 160/265

OTHER PUBLICATIONS

*Appropriate Technology Corp. Catalog,* 1984 Solarius Device.

*Primary Examiner*—Blair M. Johnson
*Attorney, Agent, or Firm*—Frank D. Gilliam

[57] ABSTRACT

The invention is directed to an awning deployment apparatus for deploying an awning over a curved surface between two substantially rectilinear surfaces while maintaining the cover taut. The cover is stowed on a motor operated roller and translated along guide tracks by the motor while maintaining tautness at all times by the stored energy of at least two wound clock like springs. The awning can be extended to any position along the guide traces.

11 Claims, 2 Drawing Sheets

AWNING DEPLOYMENT AND TENSIONING SYSTEM

BACKGROUND OF THE INVENTION

The invention is directed to powered deployment of awnings and sun shades in general and more particular to deployment of awnings and sun shades around curved structures while maintaining the awning or sun shades taut across it's surface.

It is generally known that shade awning and the like are stowed on rollers or bunched up when stowed and are pulled or operated into a deployed position when required. Common household blinds and shades are examples of these devices.

Outdoor awnings, sun shades or the like are generally permenently deployed during times of the year when sun shade is required by fixed in place metal frames or the like. In this type construction, the shades are used as decorative devices as well as functional devices.

None of the devices now utilized are able to deploy an awning, sun shade or the like cover, across the outside of a curved surface and yet maintain ideal transverse surface tautness to the deployed cover.

The emergence of the instant invention overcomes the inadequacies of the present state of the art awning deploying devices.

SUMMARY OF THE INVENTION

The invention is directed to an improved sun shade deployment device where the sun shade must cover two substantially rectilinear surfaces with a curvilinear transition therebetween and remain taut across its entire deployed surface.

The device of the invention comprises a sun shade or cover which is stored on a roller and operates along a track guide by a power means such as an electric motor with speed reduction gears and remains taut by means of at least two spring devices with reels which are wound by motor operation when the sun shade is being stowed on the roller. A tape extends between the distal end of the sun shade and the reels operated by the springs. The sun shade is held taut longitudinally by the spring tension on the tapes which are attached to the distal end of the sun shade.

A plurality of attached stays extend across the sun shade and maintain tautness in a direction transverse to the tautness maintained by the spring tension.

An object of this invention is to maintain tautness to the surface of a selectively deployable sun shade or the like.

Another object of this invention is to provide translation of a sun shade across a curvilinear surface as well as two substantially rectangular surfaces while maintaining tautness cross the surface of the sun shade.

Still another object is to employ a spring bias to maintain tautness in at least one direction of a sun shade or the like.

Yet another object of the invention is to provide thin bowed stays to maintain tautness in at least one direction of a sun shade or the like.

Of these objects, advantages and novel features of the invention will become apparent from the following detailed description of the invention when considered in conjunction with the accompanying drawings wherein.

DESCRIPTION OF THE PREFERRED EMBODIMENT

The invention is directed to a system for translating a sun shade cover or the like between a stowed position where the cover provides no shade to a position over an overhead surface and a vertical surface with a curved transition therebetween such as, for example, modernly designed sun rooms, solariums, atriums, skylights and the like the interior of which are completely exposed to sun light at certain times.

Figure 1:
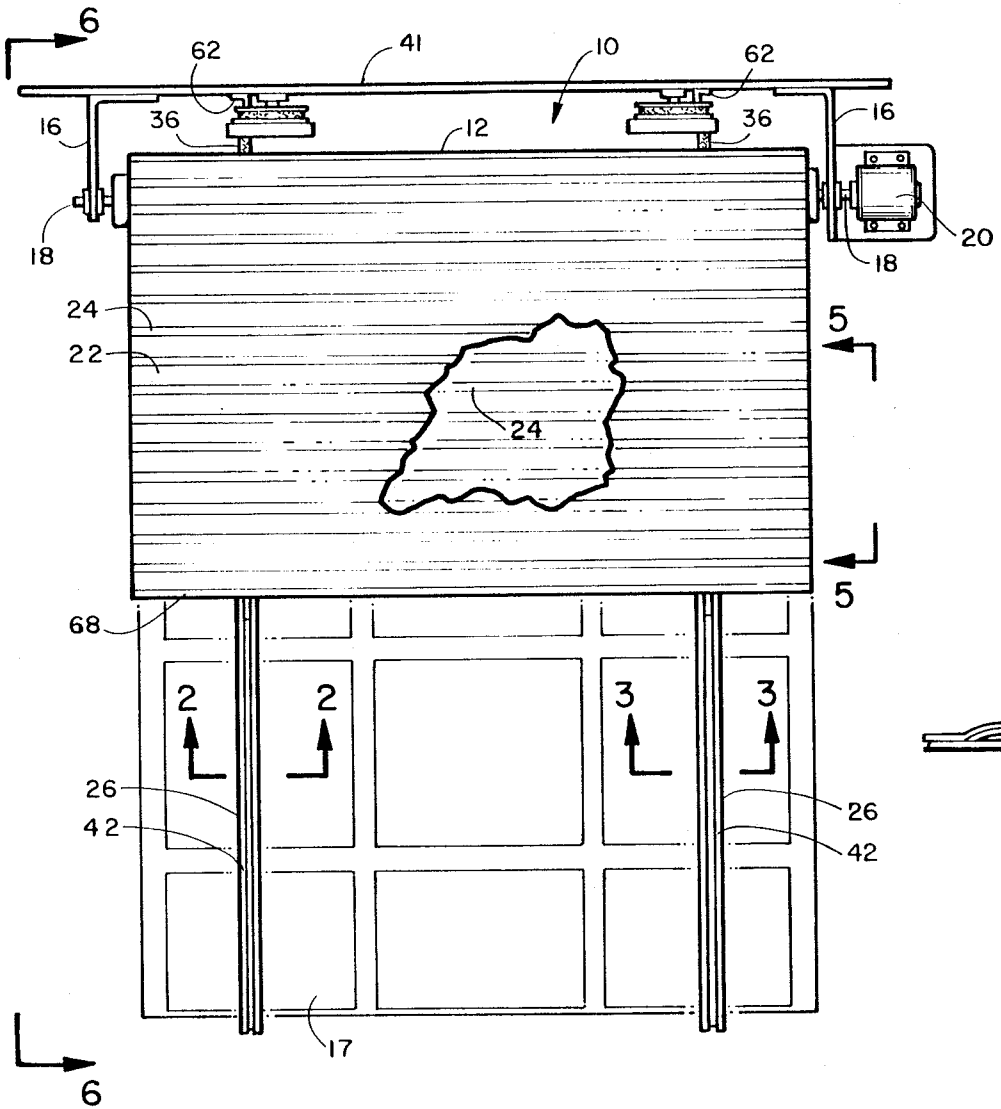
FIG. 1 is a plan view showing of the device of the invention.

Referring now to the drawing figures and specifically to FIG. 1 which depicts a plan view of the preferred embodiment 10. A roller 12 is rotatably secured to a fixed structure 14 such as a wall of a sunroom or the like. Support brackets 16 hold the rotatable roller 12 in place. An axle 18 extends from each end of the roller 12 for bracket 16 attachment. A driving motor 20 is attached to drive axle 18 and is secured to structure 14. The motor 20 is electrically wired to rotate in either direction of rotation for winding or unwinding the cover 22 on roller 12. The cover is shown winding and unwinding from the top of the roller. That the motor will not rotate in either direction when non-energized. A gear train, not shown, includes speed reduction gears to reduce the rotational speed of the electric motor 20 to a suitable cover translation speed. Motors which include a transmission for the purpose of translating awnings and the like are well known in the art.

The cover 22 is constructed of a flexible material, as for example and not by way of limitation, canvas, woven shade cloth material, plastic film of the like. The only limitation as to the construction of the cover is that it can freely be wound on roller 12 and will extend freely from the roller for the purpose intended.

A plurality of stays 24 are attached to the cover and positioned transverse to the direction of travel of the cover, i.e. they extend across the width of the cover. The stays can be attached to the cover top side for aesthetic reason or to the bottom of the cover as desired. Any method of attaching the stays to the cover in which the cover stays taut along the surface parallel to the stays could be employed to practice the invention. One means for attachment is to form long narrow pockets positioned on the upper or lower surface of the cover and insert the stays in the narrow pockets as one would insert stays in a shirt collar, foundation garment or the like. When installed in this manner the cover is made taut parallel to the direction of the stays and the ends of the pockets are secured so that the stays cannot translate within the pocket.

The stays 24 are generally made of thin material with a transverse curve for rigidity which is suitable for this purpose. Examples of such material is plastic, tempered steel and the like. Tempered steel is found to be highly desirable for this purpose.

A pair of tracks 26 extend from a location adjacent to the roller 12 along the upper substantially horizontal surface, across the curved surface at location 28 and downward extending to a location below the curve location 28, see FIG. 6. The details of the tracks will be hereinafter described in detail. The stored energy devices 30 may be a power spring (clock type), a constant force spring, a torsion spring or an equivalent thereto. The stored energy devices 30 shown contains a spring much like a common clock spring. The devices 30 are connected to structure 14 through attachment 32. With attachment 32 fixedly attached to structure, the reel or spool portion 34 is caused to rotate when the spring is either wound or unwound. A flexible tape 36 attached at one end to the portion 34 and when the spool portion rotates the flexible tape 36 is either wound or unwound therefrom. The opposite end of the flexible tape 36 is attached to stiffener member 38 which is attached to the distal end 40 of the cover. Details of the flexible tape operation will be hereinafter described in more detail. The tracks are fixedly attached shown to the upper roof surface of the enclosure which is to be shaded by the device. Screws 56 or the like may be employed to attach the bottom surface of the tracks to the roof (see FIG. 3.)

Figure 3:
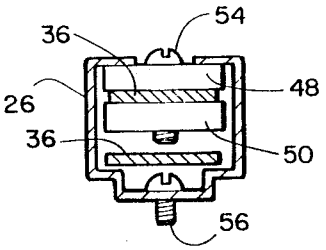
FIG. 3 is a showing taken along line 3—3 of FIG. 1, of a track of FIG. 6 after installation.
Figure 2:
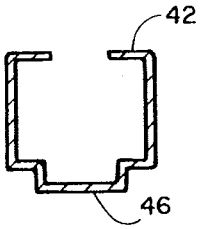
FIG. 2 is a showing taken along line 2—2 of FIG. 1, of a track prior to installation.

Referring now specifically to FIGS. 2 and 3 which depict end views of a section of the tracks 26. A section of the track extrusion before instalation is shown. The track 26 is generally open at the top surface 42 and includes an extended central portion 46 on its lower surface. As shown in FIG. 3, when the track is installed for use a pair of lubricious guides 72 are carried by the base 50 of a bracket 52, are utilized and when used with the flexible tape 36, as shown in FIG. 3, the tape is sandwiched therebetween.

The flexible tape is held firmly or locked in position by a screw 54 which extends through the guide 48, flexible tape and is threaded into the base 50. The tape, however, may be attached by any suitable means to stiffner number 38. The extended central portion 46 of the track provides a depth below the normal bottom surface of the track to enclose the fastener 56 which secures the track to the structure to be shaded. A metal screw fastener is shown. Any fastener means suitable for this purpose may be employed.

Figure 4:
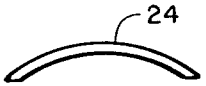
FIG. 4 is an end view of a support stay.
Figure 5:
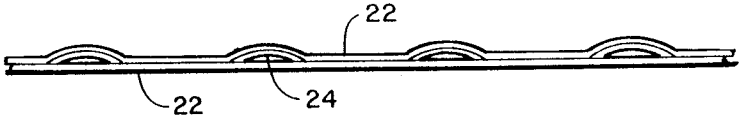
FIG. 5 is a sectional showing of the sun shade taken along line 5—5 of FIG. 1.

Referring now to FIGS. 4 and 5 which depict the cross-section shape of the stays 24 and an attached position on the cover 22. The stays are formed of material suitable for the purpose intended. The stays are preferably curvilinear, as shown, to provide the most stiffness with minimum thickness and to store against the curvature of the roller 12 when this awning is stowed thereon. Ideally the stays are constructed of high tempered steel, as aforementioned, of an approximate thickness of 0.006 inches, much like a slat of a mini-blind. The radius of the curvature of approximately five eights of an inch is found to be very satisfactory. Other thickness and radius of curvature may be chosen depending on the type of material and thickness with which the stays are constructed.

Figure 6:
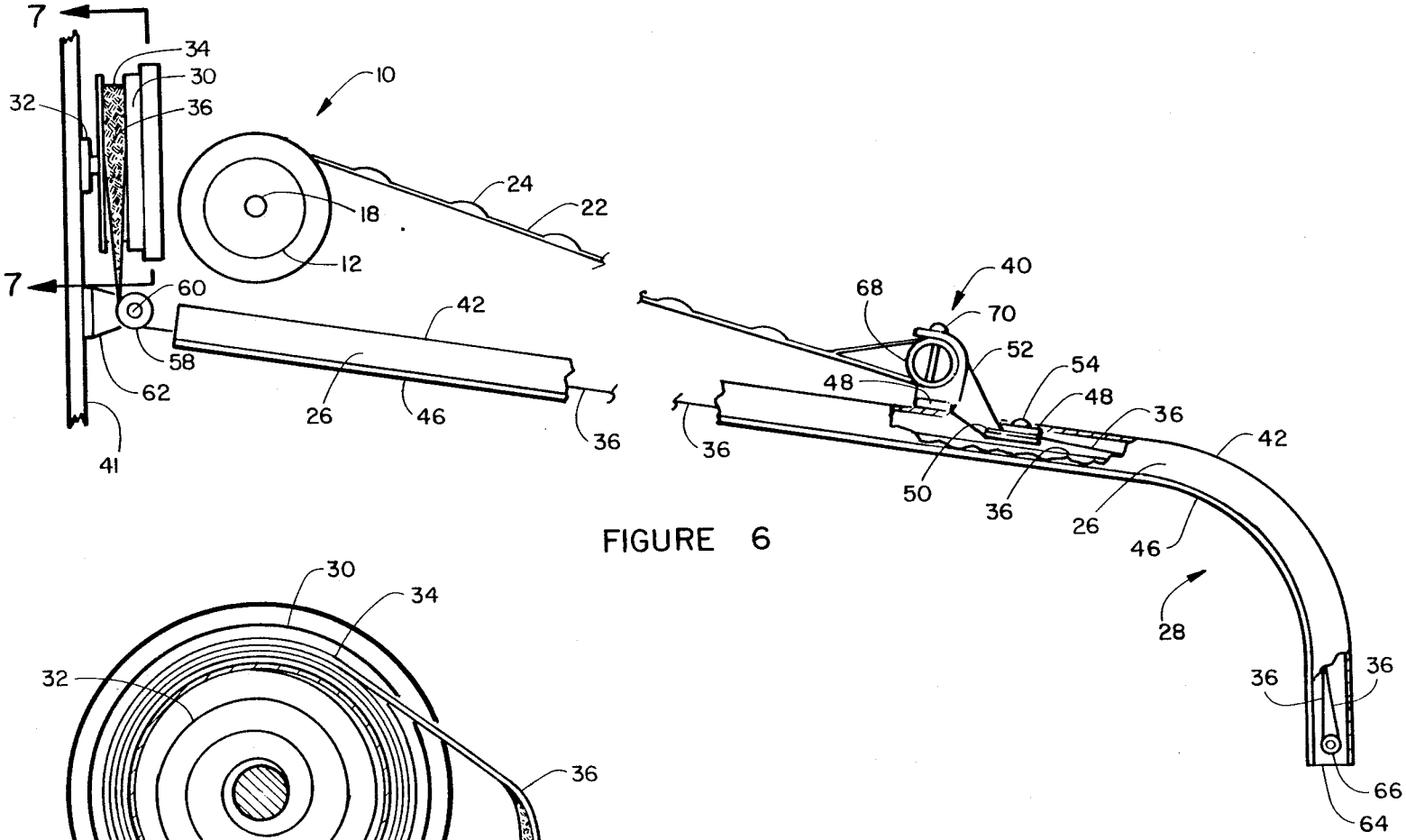
FIG. 6 is a showing in detail taken along line 6—6 of FIG. 1.
Figure 7:
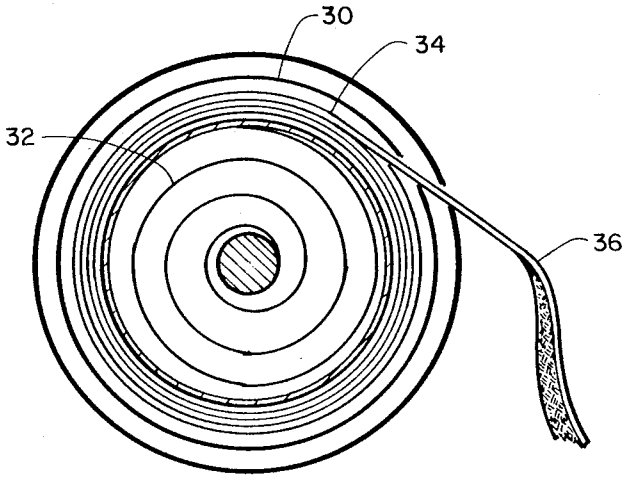
FIG. 7 is a showing taken along line 7—7 of FIG. 6.

Referring now specifically to FIG. 6, a cutaway view taken along line 6-6 of FIG. 1 is shown.

The flexible tape 36 extends from the reel 34 of the stored energy device around a direction turning guide roller 58 constructed of lubricious material. The roller 58 is rotatably connected through axle 60 to mounting bracket 62 attached to structure 14. The tape 36 extends along the inside of track 26 to the distal end 64 of the track. Positioned within the track adjacent to the distal end 64 is a pulley 66 rotatably mounted to the side walls of the track. The tape 36 extends around the pulley and extends back up the inside of the track where it is attached to bracket 52 attached to stiffner 38 in a manner hereinbefore described. Although the spring device 30 is shown and described as attached to structure for ease of explanation, it should be understood that the spring device 30 would work equally as well if positioned at the lower end of tracks 26 or at surface level.

The distal end of the cover 22 is connected to bracket 52 by means of the rigid stiffener cross member shown as a tube 68. The cover 22 wraps around the tube 68 as shown and is attached to the top surface of the cover adjacent thereto. The bracket 52 is shown as semi-circular and transfers the load from the strap 36 to the distal end of the cover. A bolt 70 extends through the bracket 52 nd threadly engages a lubricious guide number 72.

The guides 48 and 72 maintain the bracket 52 against the inner and outer surface of the track at all positions of the translation of bracket 52.

When the systems for cover translation 10 is installed, the cover is wound around roller 12 to a cover stored position and the springs of stored energy devices 30 are fully wound for maximum stored energy.

To translate the cover from a stored position on the roller, the motor is operated causing the spring to rotate the reels in a clockwise direction winding up and maintaining tension on the flexible tape which pulls against bracket 52 along track 26 toward the distal end 64. Terminating the operation of the motor 20 will terminate translation of the cover with the spring tension maintaining tautness to the cover. At any location of the distal end of the cover 22 the translation may be terminated. When the bracket 52 reaches the pulley 66, translation is automatically stopped (fully depolyed). Obviously the position of the track distal ends from a floor surface and length of the cover determines the maximum translation distance. The spring tension of the reel maintains tautness to the cover in a longitudinal direction.

The return of the cover 22 to its stored position from a depoloyed position is accomplished by operating the motor 20 in the opposite direction of rotation until the cover is fully wound on the roller. As the cover is wound on the roller, the tensioning tape 26 is being extended to replace the length of the cover wound on the roller maintaining sufficient tension to maintain tautness and rewinding the spring of the power storage devices 30.

When fully stored the cover translation can be repeated in the same manner.

the tracks are generally constructed of aluminum or the likeTby extruding methods well known. The lubricious material can be any slick material as can be the flexible tape 28 such as Nylon ®, Teflon ®, Delrin ®, or the like which present minimal friction when engaging itself or other less friction-free materials.

It is important that the flexible tape 26 be lubricious in nature as it rubs on itself when turning the curved portion 28 of the track.

Obviously many modifications and variations of the present invention are possible in light of the above teachings. It is therefore to be understood that within the scope of the appended claims the invention may be practical otherwise than as specifically described.

What is claimed is:

1. Apparatus for translating the free end of an extendable flexible cover between stowed and deployed positions comprising:

an elongated flexible cover having side edges, a secured end and a free end;

storage means for storing at least a portion of said cover in a non-deployed position and fixedly securing said secured end of said cover, said storage means comprises a roller;

track means adjacent to said cover, positioned intermediate the side edges of said cover and extending substantially the length of said cover, as measured when said cover is in its depolyed position said cover being translatably attached to said track means, said track means comprises a pair of track members, one of which is positioned on each side of the longitudinal center of said cover between stowed and deployed positions;

translating means which translate said cover along said track means to any position between fully deployed and stowed positions;

tensioning means associated with said cover for maintaining said cover in both longitudinal and transverse tautness at all positions between fully deployed and stowed positions, said tensioning means comprising transverse fixedly positioned flexible stiffening means having a length substantially the width of said cover for maintaining transverse tautness and flatness to said cover at all positions thereof, said transverse stiffening means comprise a plurality of spaced apart elongated stays attached to said cover that extend across said cover and perpendicular to said track members for maintaining said cover flat adjacent to said stays and said longitudinal tensioning means comprises an energy storage means comprising at least two power springs reels positioned perpendicular to said track means, the rotational axes of said reels being perpendicular to said roller, each reel having an inner spring and a length of flexible tape fixedly attached at one end thereof, the other end of said tape extends to the distal end of said track means, said tape is redirected from each of said reels around a first and second pulley and extends to the free end of said cover adjacent to said track means where the other end of said tape is fixedly attached to said cover for maintaining longitudinal tension on said cover, said translating means comprising rotating means which rotates said roller between cover deployed and stowed positions, whereby when said cover is in a stowed position said spring has a maximum store of energy and when said cover is translated said tape is pulled toward and wound on said reel by said spring maintaining tension on said cover and when it is desirable to return said cover to the stowed position, said roller is rotated by said rotating means winding said cover on said roller and replacing stored energy to said power storing reels while maintianing tension on said cover; and attachment means for fixedly positioning said storage means and said energy storage means.

2. The invention as defined in claim 1 wherein said storage means comprises a roller and said translation means comprises a motor for selective rotation of said roller 3. The invention as defined in claim 1 wherein said track means comprises a channel member which extends between the cover stowed and deployed positions.

4. The invention as defined in claim 1 wherein said stays are attached to said cover and spacedly positioned along the length of said cover 5. The invention as defined in claim 4 wherein said stays are thin metal stays of approximately 0.006 inches thick.

6. The invention as defined in claim 1 wherein said stays are curvilinear stays having concave and convex surfaces said concave surface positioned adjacent said track means.

7. The invention as defined in claim 6 wherein said are constructed of metal stays.

8. The invention as defined in claim 7 wherein said metal stays are constructed of tempered steel.

9. The invention as defined in claim 1 wherein each of said tapes is formed of lubricious material and is concealed within a track member.

10. The invention as defined in claim 1 wherein a rigid cross-member is attached to the free end of said cover and said tapes are attached to said rigid cross-member, said rigid member is guided along said track means by lubricious guide means attached thereto.

11. The invention as defined in claim 10 wherein said track members include a slot along an upper central surface and said guide means being designed to travel along said slot.

* * * * *